United States Patent [19]

Spitaler

[11] Patent Number: 4,681,338

[45] Date of Patent: Jul. 21, 1987

[54] SAFETY SKI BINDING

[75] Inventor: Engelbert Spitaler, Neudorf, Austria

[73] Assignee: TMC Corporation, Baar, Switzerland

[21] Appl. No.: 755,177

[22] Filed: Jul. 15, 1985

[30] Foreign Application Priority Data

Jul. 13, 1984 [AT] Austria ..... 2267/84

[51] Int. Cl.[4] ..... A63C 9/08

[52] U.S. Cl. ..... 280/628; 280/626

[58] Field of Search ..... 280/626–628

[56] References Cited

U.S. PATENT DOCUMENTS

| | | | |
|---|---|---|---|
| 4,222,584 | 9/1980 | Kikuchi | 280/626 |
| 4,294,461 | 10/1981 | Eckart | 280/628 X |
| 4,421,341 | 12/1983 | Krob et al. | 280/628 |
| 4,531,758 | 7/1985 | Svoboda et al. | 280/628 |
| 4,533,155 | 8/1985 | Krob et al. | 280/628 |

FOREIGN PATENT DOCUMENTS

| | | | |
|---|---|---|---|
| 2659369 | 1/1978 | Fed. Rep. of Germany . | |
| 3432826 | 3/1985 | Fed. Rep. of Germany | 280/628 |
| 1485708 | 6/1967 | France . | |

*Primary Examiner*—Nancy A. Swisher

*Attorney, Agent, or Firm*—Flynn, Thiel, Boutell & Tanis

[57] ABSTRACT

A safety ski binding includes a base member having a sole holder pivotally supported thereon, and a locking mechanism biased by a locking spring can releasably hold the sole holder in a downhill skiing position. The locking mechanism includes a control surface provided on the rear portion of the sole holder and a locking lever biased by the locking spring into engagement with the control surface. A hand lever is pivotally supported on the locking lever and has a manually operable force arm, a load arm which can engage the sole holder and move it toward its open position when the force arm is moved in a first direction, and an extension which can engage the sole holder and move it toward its downhill skiing position when the force arm is moved in a second direction opposite the first direction.

10 Claims, 5 Drawing Figures

SAFETY SKI BINDING

FIELD OF THE INVENTION

This invention relates to a safety ski binding and, in particular, to a binding having a sole holder which can be pivoted upwardly about a transverse axis relative to a base member, which is releasably held in its position of use by a locking spring which acts onto a locking mechanism, and which is movably supported on the base member, the locking mechanism including a control surface on a rear region of the sole holder and a locking lever which is movably supported on the base member and which supports a two-arm hand lever hinged to its portion which extends above the swivel axis, the lower arm of the hand lever being a load arm which grips under the sole holder and the other arm being a force arm which is constructed as an operating lever, wherein the hand lever eliminates through compression of the locking spring the spring biasing of the locking mechanism so that the sole holder can be swung upwardly substantially force-free.

BACKGROUND OF THE INVENTION

A safety ski binding of the above-described type is disclosed in French Patent No. 14 85 708. However, the hand lever in this known solution serves exclusively as an opening lever, so that for closing the binding the entire sole holder must be swung downwardly against the force of the release lever. This operation is complicated, particularly during mounting. However, it is also complicated for the skier, who after stepping out of the binding may need to close same, for example for transport.

The invention begins here, and one purpose of the invention is to improve a safety ski binding of the above-mentioned type so that the closing of the binding can be carried out easily by means of the hand lever.

SUMMARY OF THE INVENTION

This purpose is attained inventively by providing on the hand lever an extension which engages the sole holder and which, through swinging of the hand lever in a closing direction, closes the sole holder.

The hand lever, which is already provided, can in this manner also be used for closing the binding by pivoting the hand lever in a direction opposite its opening direction.

A particularly advantageous embodiment of the invention involves the extension being provided on a load arm of the hand lever and forming with the free end of the load arm a type of forking, the free end of the load arm, viewed in a top view, ending in two fork prongs which grip around the sole holder, wherein in each position of the heel holder the hand lever engages the sole holder either with its two fork prongs or with its extension. A particularly space-saving construction is made possible with this development.

A further development of the thought of the invention involves the extension being supported, at least during closing of the sole holder, on a bearing surface of the sole holder which, in this position of the heel holder, defines with its base plate a forwardly opening acute angle, preferably at an angle of 30° to 60°.

A further development of the preceding thought of the invention involves the extension having a nose which is supported, in the open position of the heel holder, on the bearing surface of the sole holder.

For the purpose of a low friction force transmission, it is provided according to a further characteristic of the invention that the extension has a shoulder, by means of which the extension is supported on the bearing surface of the sole holder, and that the shoulder and/or the bearing surface carries a glide strip of a low friction material, is coated with such a material, or is made of such a material.

To avoid a redundancy in control between the sole holder and the extension or fork prongs, and also to avoid undesired noise during skiing, it is provided according to a further characteristic of the invention that, in the closed position of the heel holder, the extension or its shoulder on the one hand and the two fork prongs on the other hand grip around the sole holder with a clearance, the hand lever being initially tensioned toward the sole holder by means of a spring which preferably engages its load arm.

It is particularly advantageous for structural reasons if, according to a further characteristic of the invention, the spring is provided on the cover of the sole holder of the heel holder, preferably in the form of a plastic spring constructed of the material of the sole holder.

Another advantageous development of the invention involves the locking lever which carries the hand lever being biased by the locking spring with the interpositioning of a second locking lever, which is also movably supported on the base member.

It is already known from Austrian Patent No. 370 633 to arrange two locking levers between the locking spring and the sole holder, but it is not known to carry this out in a safety ski binding of the above-mentioned type. Thus, the afore-mentioned solution with the initially discussed thought of the invention forms a further advantageous inventive solution.

A further development of this thought of the invention involves the first locking lever being connected to the second locking lever by at least one plate, preferably a pair of plates, which plates are hinged by means of bolts to the first and second locking levers. This development increases the precision of the connection between the two locking levers, and the support which is formed by two rollers reduces the created friction forces.

BRIEF DESCRIPTION OF THE DRAWINGS

Further characteristics, advantages and details of the invention will now be described in greater detail in connection with the drawings, which illustrate two exemplary embodiments.

In the drawings.

DETAILED DESCRIPTION

Figure 1:
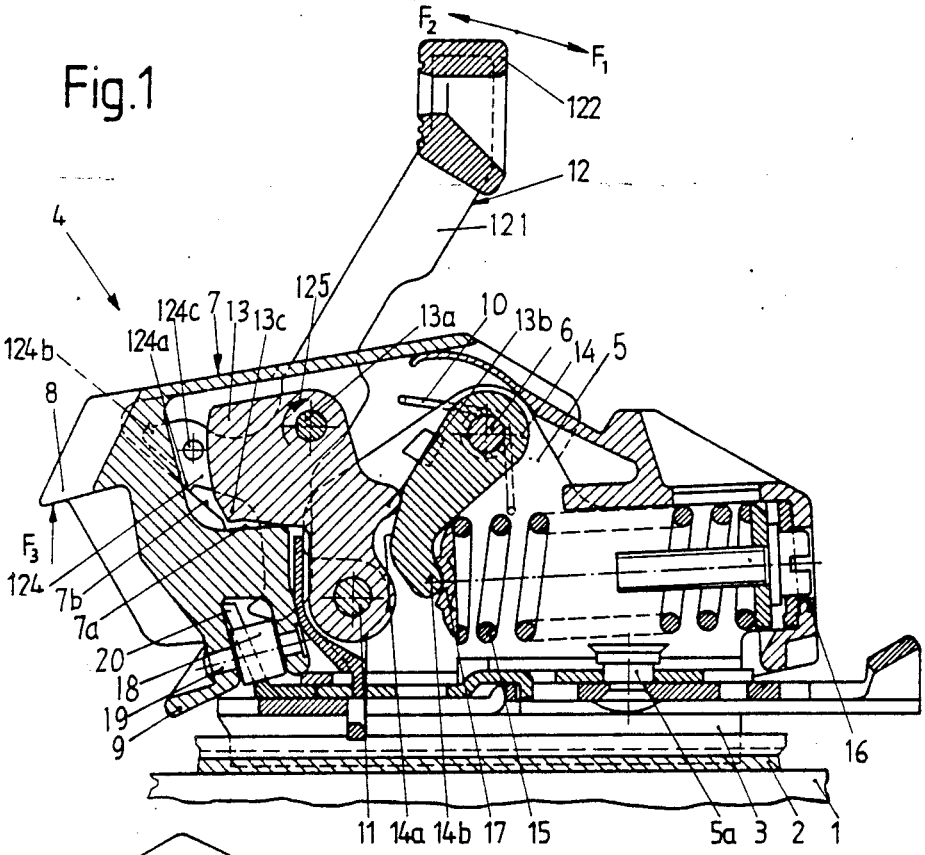
FIG. 1 is a longitudinal sectional side view of a first embodiment of a ski binding embodying the invention.

As one can take from FIGS. 1 to 4, a guide rail 2 is secured in a conventional manner on the upper side of a ski, for example by means of screws which are not illustrated. A base plate 3 of a ski binding, which is identified in its entirety as a heel holder 4, is supported for movement in the longitudinal direction of the ski 1 on the rail 2 and can be releasably locked in desired positions, also in a conventional manner.

A base member 5 is pivotally supported in a conventional manner on a bolt 5*a* which is constructed as a vertical axle on the base plate 3 of the heel holder. Measures are taken for this to provide the heel holder 4 with the capability to carry out a so-called diagonal release, as is discussed in greater detail hereinafter.

First and second locking levers 13 and 14 are supported on the base member 5. In particular, the base member 5 carries a first transverse axle 6 which extends across an upper region thereof. A sole holder, which is identified in its entirety with reference numeral 7, is pivotally supported on the axle 6 and the second locking lever 14, which will be described in greater detail later on, is also pivotally supported on the transverse axle 6. The sole holder 7 has a sole down-holding portion 8, a stepping mandrel 9, a cam or control surface 7*a* which acts as a counter-notch or locking part, and a bearing surface 7*b* (see in particular FIG. 4) for an arm of a hand lever 12 which will be described in greater detail later. Furthermore, a second transverse axle 11 extends through the base member 5, on which axle is pivotally supported the first locking lever 13, which also is a part of the locking mechanism. The locking lever 13 carries a swivel axle 13*a*, on which is pivotally supported the hand lever 12 which forms the important part of the invention.

The hand lever 12 is designed as follows. The region of the hand lever 12 which extends above the swivel axle 13*a* acts as a force arm 121. The force arm has at the end a receiving piece 122, for example of a plastic material, which can be operated by means of a ski pole and is shaped in a conventional manner for this purpose.

A load arm 123 of the lever 12 extends below the swivel axle 13*a* (see in particular FIG. 4) and has at its lower end an undercut engageable with the lower rear end region of the sole holder 7. Furthermore, the load arm has an extension 124 extending approximately at a right angle to a plane which extends through the longitudinal center line of the hand lever 12 and which extends perpendicular to the drawing plane. The hand lever 12 is generally U-shaped and has two spaced legs 12*a* and 12*b*, each of which has a part of the load arm 123 and part of the extension 124 thereon. The free end of the load arm 123 and the free end of the extension 124 form a type of fork prongs on the hand lever 12, wherein at least one of these two fork prongs is engaging the sole holder 7 in every position of the heel holder 4. The extension 124 has a shoulder 124*a* and a nose 124*b*, by means of which the extension 124 is supported selectively on the bearing surface 7*b* of the sole holder 7. The shoulder 124*a* also serves as a stop for the hand lever 12, in order to avoid deflecting the housing of the sole holder 7 therewith. At the start of the closing operation, the nose 124*b* of the extension 124 rests on the bearing surface 7*b* of the sole holder 7. Furthermore, the friction forces which are created during the closing operation are reduced by means of the shoulder 124*a* or the nose 124*b*. A further measure, namely that the shoulder 124*a* and/or the bearing surface 7*b* carries a glide strip of a low friction material, is coated with such a material, or is made of such a material, serves the same purpose. These measures are known by themselves, so that a glide strip or the like is not illustrated. Tetrafluoroethylene is considered the most appropriate low friction material, and can be commercially obtained, for example under the Trademark "Teflon".

Figure 4:
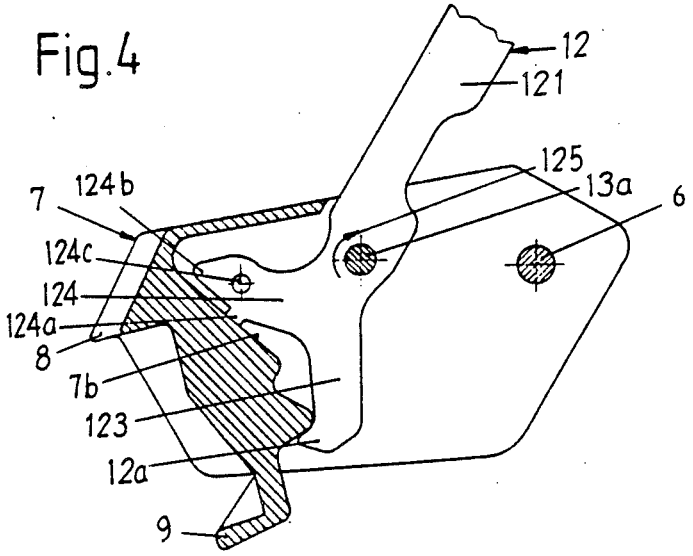
FIG. 4 is a fragmentary sectional side view of the embodiment of FIG. 1 taken along the line IV—IV in FIG. 2.

As one can take in particular from FIG. 4, the shoulder 124*a* of the extension 124 and the forked ends 12*a* and 12*b* of the load arm 123 grip with play around the sole holder 7 in the closed position of the heel holder 4, through which redundancy in the control thereof is avoided. In order to avoid the noises which might possibly be created during skiing through this, the hand lever 12 is initially tensioned toward the sole holder 7 by means of a light spring, which is indicated schematically by the arrow 125.

The second locking lever 14, which is adjacent the first locking lever 13 in the illustrated exemplary embodiment, as has already been mentioned, is biased on its side which does not face the first locking lever 13 by one end of a locking spring 15, the other end of which is supported in a conventional manner on the base member 5, and the spring 15 can be changed with respect to its initial tension by means of an adjusting device which is identified as a whole with reference numeral 16. Such adjusting devices are known, so that a further discussion regarding its construction and operation should not be necessary. The first locking lever 13 has on its side which faces the second locking lever 14 an extension 13*b*. This extension rests on a front support surface 14*a* of the second locking lever 14. The lever 14 has a rearwardly projecting nose 14*b* which lies in a panlike recess in a spring plate 17 for the locking spring 15.

Even though FIGS. 1 to 4 illustrate two locking levers 13 and 14, according to the invention only one locking lever is essential. By using two locking levers, the force transmission ratio is improved. For this reason, it is expressly pointed out that the invention relates primarily to the special form of the hand lever 12 and can thus be realized even in connection with only one locking lever. In the case where lever 14 is omitted, the extension 13*b* of the locking lever 13 would lie in the panlike recess in the spring plate 17.

The front region of the first locking lever 13, which faces the cam or control surface 7*a*, has a locking nose 13*c* which cooperates with the locking part 7*a* on the sole holder 7, namely the cam or control surface 7*a*, thereby forming a part of the locking mechanism. The sole holder 7 is biased by a torsion spring 10 which urges it toward its open position.

If a force acts in a vertical direction onto the heel holder 4, as indicated by the arrow $F_3$, then the sole holder 7 is pivoted clockwise about the first transverse axle 6. The cam or control surface 7*a* presses against the locking nose 13*c* of and pivots the first locking lever 13, which in turn through its extension 13*b* biases the second locking lever 14 so that the lever 14 pivots about the first transverse axle 6 and compresses the locking spring 15. It will be recognized by the man skilled in the art, without any further illustration, that when the force $F_3$ stops before the cam or control surface 7*a* comes free from the locking nose 13*c*, the locking spring 15 continues to bias the second locking lever 14, which transfers the force to the first locking lever 13 which in turn swings the sole holder 7 back into its closed or downhill skiing position.

Figure 3:
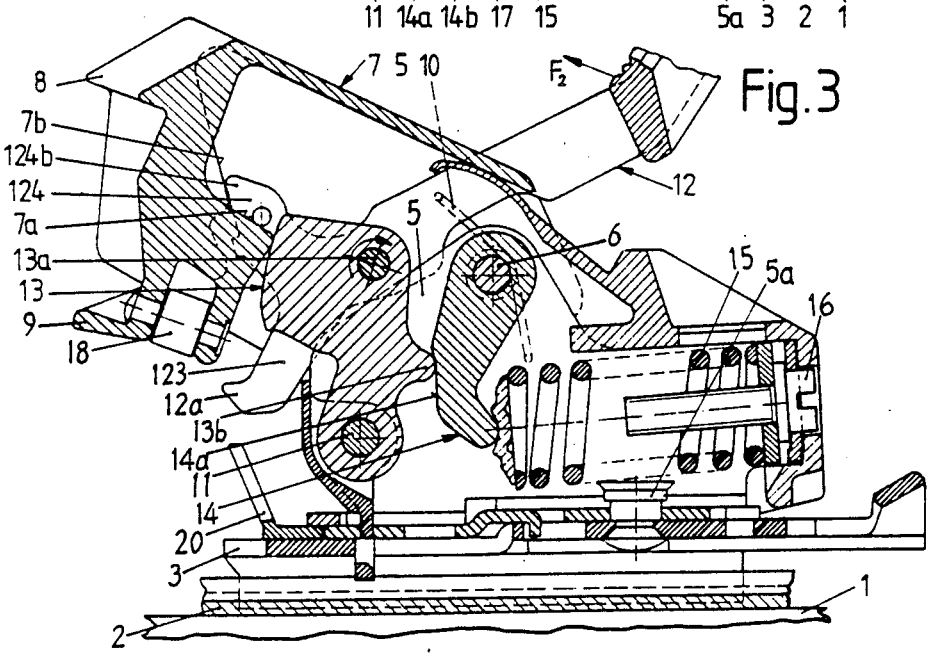
FIG. 3 is a longitudinal sectional side view similar to FIG. 1 but showing the binding of FIG. 1 in an open position.
Figure 2:
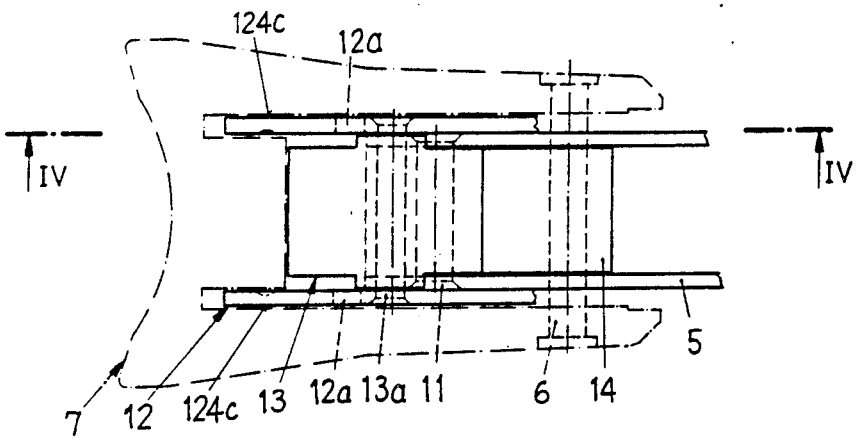
FIG. 2 is a top view of the embodiment of FIG. 1, some components being shown in broken lines for clarity.

In contrast, if the force $F_3$ is sufficiently great so that the cam or control surface 7a comes free from the locking nose 13c, then the open position which is illustrated in FIG. 3 is reached and the ski shoe, which is not illustrated, is freed from the binding. The sole holder 7 remains, under the urging of the locking spring 15 and the torsion spring 10, in the open position ready for stepping in.

During a voluntary stepping out of the binding, the hand lever 12 is pressed rearwardly and downwardly in the direction of the arrow $F_1$. By pressing down the hand lever 12, on the one hand pressure is applied from the first locking lever 13 through the second locking lever 14 onto the locking spring 15, and on the other hand a force in the opening direction is applied to the sole holder 7 by the end of the load arm 123. Due to the existing force transmission ratios, an easier stepping out is assured in this manner, without requiring the skier to directly overcome the entire force of the locking spring 15. This release operation is otherwise similar to that described above in connection with an automatic release.

When the heel holder 4 is to be closed, the hand lever 12 is swung in the direction of the arrow $F_2$, wherein movement from the position which is illustrated in FIG. 3 to the position according to FIG. 1 is to be effected. It can thereby be easily recognized that, due to the engagement of the extension 124 on the bearing surface 7b of the sole holder 7, the sole holder 7 can be moved with a relatively small force to its closed position, because it is sufficient to slightly compress the locking spring 15 in order to let the rear region of the sole holder 7 slide down along the front region of the first locking lever 13. Furthermore, a stamping or boss 124c can be recognized on the extension 124 and engages a sidewall of the sole holder 7 in order to reduce friction between the sidewall of the sole holder 7 and the hand lever 12.

It was already initially mentioned that the base member 5 of the heel holder 4 is supported pivotally about the bolt 5a. Through this a diagonal release is assured, which is known by itself and does not itself form a part of the subject matter of the present invention. It is mentioned only in order to explain that the inventive measure can also be realized in connection with a heel holder capable of a diagonal release. Of the measures which are necessary for this, a roller 18 is recognizable in the lower region of the sole holder 7, which roller 18 is rotatably supported on the sole holder 7 by means of a holding bolt 19. As a counter-element for this, a notch 20 is provided on the base plate 3, which notch 20 receives the roller 18 in the downhill skiing position and blocks a purely lateral release, pivotal movement around the bolt 5a of the base member 5 being permitted only when vertical forces are also acting onto the heel holder 4 and have caused a predetermined amount of swinging up of the sole holder 7.

Figure 5:
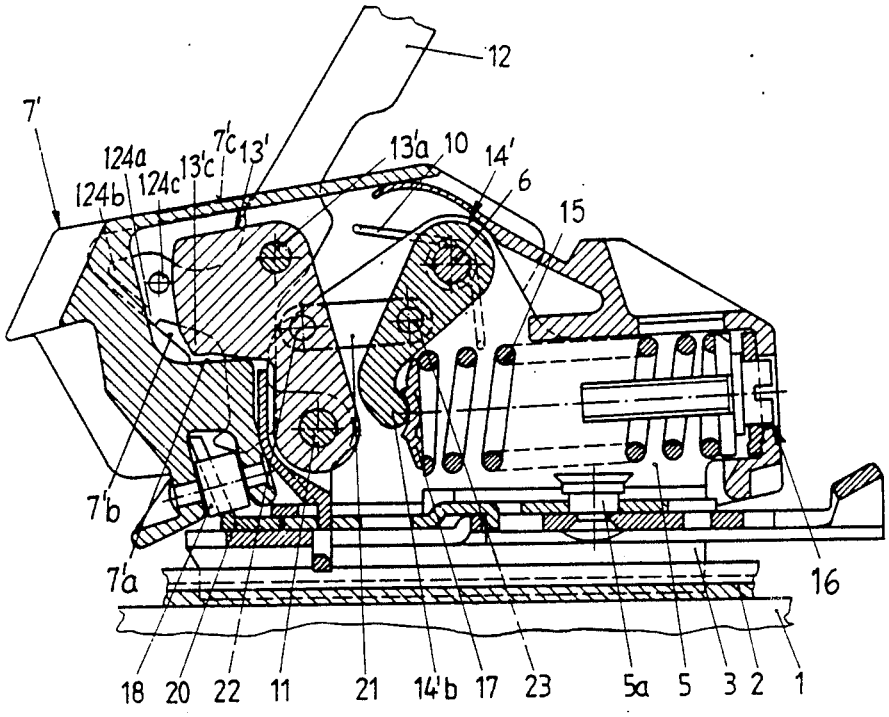
FIG. 5 is a view similar to FIG. 1 showing another exemplary embodiment of the binding of FIG. 1, including two locking levers which are connected to one another by means of plates.

The second exemplary embodiment according to FIG. 5 differs from the first exemplary embodiment only by the first locking lever 13' being connected to the second locking lever 14' through a pair of plates 21 which are hinged by means of bolts 22 and 23 to the locking levers 13' and 14'. The hand lever 12 in this case engages a spring 7'c which is formed by a resilient portion of the cover of the housing of the sole holder 7'. This makes the use of a separate spring (designated diagrammatically by arrow 125 in FIG. 1) within the housing unnecessary. The remaining structure and the operation of the heel holder 4' according to FIG. 5 correspond with that of the embodiment which has already been described.

It is further important for the invention if the extension 124 carries at least one boss 124c. With this, the friction forces which occur between the side surfaces of sole holder and hand lever are reduced.

The invention, as has already been mentioned, is not limited to the illustrated exemplary embodiment. Further modifications and variations, including the rearrangement of parts, are possible without leaving the scope of the invention. For example, the upper region of the spring housing can be designed resiliently and can urge the sole holder toward its open position, through which the use of a separate opening spring 10 is not needed. Further, it is possible to provide several bosses on the extension, or the side surfaces of the sole holder and/or hand lever can be coated with a low friction material.

The inventive measure can also be used in a heel holder without capability for a diagonal release. Furthermore, the use of the shoulder or boss 124c on the extension 124 is not needed when other geometric relationships exist, for example in the case of a children's heel holder.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a safety ski binding having a sole holder which can be pivoted about a transverse axis between a downhill skiing position and an open position relative to a base member, which is releasably held in its downhill skiing position by a resilient locking member which acts onto the sole holder through a locking mechanism, and which is supported on the base member, wherein the locking mechanism includes a control surface which is constructed on a rear region of the sole holder and includes a locking lever which is supported on the base member for movement about a swivel axis, the locking lever pivotally supporting a two-arm release lever on a portion thereof which extends above the swivel axis, a first arm of the release lever being a load arm which grips under a portion of the sole holder and a second arm thereof being a force arm which is constructed as an operating lever, and wherein movement of the release lever in a release direction counteracts, through compression of the resilient locking member, the resilient force acting on the locking mechanism so that the sole holder can be swung upwardly from its downhill skiing position to its open position substantially free of resistance from the locking mechanism, the improvement comprising wherein the release lever has an extension which can engage the sole holder and which, when the sole holder is in its open position and the release lever is moved in a closing direction, engages the sole holder and moves the sole holder to its downhill skiing position.

2. A binding according to claim 1, wherien the extension is provided on the load arm of the release lever and forms with a free end of the load arm of the release lever a fork, wherein the free end of the load arm, viewed in a top view, ends in two fork prongs which grip under the portion of the sole holder, and wherein in each position of the heel holder the release lever engages the sole holder with one of the load arm and the extension.

3. A binding according to claim 2, wherein the extension is supported, at least during movement of the sole holder from its open position to its downhil skiing position, on a bearing surface of the sole holder which, in the downhill skiing position, defines with a base plate of the heel holder a forwardly opening acute angle in the range of 30° to 60°.

4. A binding according to claim 3, wherein the extension has a nose which, in the open position of the sole holder, is supported on the bearing surface of the sole holder.

5. A binding according to claim 1, wherein the extension has a shoulder which can engage a bearing surface on the sole holder, and wherein one of the shoulder and the bearing surface has low friction means which is slidably engaged by the other thereof.

6. A binding according to claim 2, wherein in the downhill skiing position of the heel holder the extension and the two fork prongs have said portion of the sole holder disposed therebetween with a clearance, and including resilient means yieldably urging movement of the release lever in a direction causing one of the extension and the fork prongs to be urged against the sole holder.

7. A binding according to claim 6, wherein the resilient means is provided on a cover portion of the sole holder and includes a plastic spring element which is made of the material of the sole holder and can engage the release lever.

8. A binding according to claim 1, wherein the resilient locking element is a locking spring, and wherein the locking lever which carries the release lever is biased by the locking spring through a second locking lever which is also movably supported on the base member.

9. A binding according to claim 8, wherein the first locking lever is coupled to the second locking lever by at least one plate which is hinged to the first and second locking levers by means of bolts.

10. A binding according to claim 1, wherein the extension carries at least one boss which is slidably engageable with a surface on the sole holder.

* * * * *